US011195383B2

(12) United States Patent
Oochi

(10) Patent No.: US 11,195,383 B2
(45) Date of Patent: Dec. 7, 2021

(54) SERVER SYSTEM, GAME SYSTEM, TERMINAL DEVICE, AND METHOD OF PROVIDING INFORMATION RELATED TO GAME

(71) Applicant: BANDAI NAMCO ENTERTAINMENT INC., Tokyo (JP)

(72) Inventor: Hiroaki Oochi, Tokyo (JP)

(73) Assignee: BANDAI NAMCO ENTERTAINMENT INC., Tokyo (JP)

( * ) Notice: Subject to any disclaimer, the term of this patent is extended or adjusted under 35 U.S.C. 154(b) by 0 days.

(21) Appl. No.: 16/992,613

(22) Filed: Aug. 13, 2020

(65) Prior Publication Data

US 2021/0049872 A1 Feb. 18, 2021

(30) Foreign Application Priority Data

Aug. 13, 2019 (JP) ..... JP2019-148487

(51) Int. Cl.
*G07F 17/32* (2006.01)

(52) U.S. Cl.
CPC ..... *G07F 17/3293* (2013.01); *G07F 17/329* (2013.01); *G07F 17/3237* (2013.01); *G07F 17/3244* (2013.01); *G07F 17/3262* (2013.01); *G07F 17/3269* (2013.01); *G07F 17/3281* (2013.01)

(58) Field of Classification Search
USPC ..... 463/13, 12, 11
See application file for complete search history.

(56) References Cited

U.S. PATENT DOCUMENTS

| | | | | |
|---|---|---|---|---|
| 9,333,432 | B2 * | 5/2016 | Inagawa | A63F 13/69 |
| 10,213,694 | B2 * | 2/2019 | Ohashi | A63F 13/822 |
| 10,661,179 | B2 * | 5/2020 | Ohashi | A63F 13/822 |
| 2014/0295972 | A1 * | 10/2014 | Inagawa | A63F 13/335 463/42 |
| 2014/0295973 | A1 * | 10/2014 | Inagawa | A63F 13/69 463/42 |

FOREIGN PATENT DOCUMENTS

JP 2016-185284 A 10/2016

* cited by examiner

*Primary Examiner* — Pierre E Elisca
(74) *Attorney, Agent, or Firm* — Oliff PLC

(57) ABSTRACT

In the case where a combination instruction to combine a lower-ranked first game card in which a specific ability parameter is specified with a higher-ranked second game card is received, a sever executes determination processing of determining whether the first game card meets a given combination condition and, in the case where it is determined that the first game card meets the combination condition, the sever executes, as combination processing, specific ability addition processing of adding the specific ability parameter specified in the first game card to the second game card.

9 Claims, 6 Drawing Sheets

| CARD ID | CARD TYPE | RANK ATTRIBUTE | ABILITY PARAMETER 1 (UPPER PART: CURRENT VALUE) (LOWER PART: UPPER LIMIT VALUE) | ABILITY PARAMETER 2 (UPPER PART: CURRENT VALUE) (LOWER PART: UPPER LIMIT VALUE) | ... |
|---|---|---|---|---|---|
| SI001 | PLAYER CHARACTER | NORMAL | 51 | 15 | ... |
| | | | 150 | 100 | ... |
| SI002 | PLAYER CHARACTER | RARE | 25 | — — | ... |
| | | | 100 | — — | ... |
| ⋮ | | | ⋮ | ⋮ | ⋮ |

FIG. 5

SERVER SYSTEM, GAME SYSTEM, TERMINAL DEVICE, AND METHOD OF PROVIDING INFORMATION RELATED TO GAME

Japanese Patent Application No. 2019-148487, filed on Aug. 13, 2019, is hereby incorporated by reference in its entirety.

BACKGROUND OF THE INVENTION

The present invention relates to a server system, a game system, a terminal device, and a method of providing information related to a game.

In recent years, with an increase in the versatility of an information communication terminal device such as a tablet-type information communication terminal device or a smartphone, or a personal computer (hereinafter referred to as a "communication terminal device"), an improvement in the function of the communication terminal device, and the spread of the communication terminal device, the opportunity to execute games in these communication terminal devices has been increased.

In particular, recently, there is provided an online game called a social game in which a communication-type networking service called a social networking service (hereinafter referred to as an "SNS") and a game are combined.

As such online games, games such as a battle game, a combat game, and an RPG are provided among players via portable information communication terminal devices such as smartphones.

As one of systems (i.e., game systems) which provide games of this type, there is known a system in which, by using another game medium by a method of combination, the upper limit value of a parameter specified in a game medium is changed, a specific game medium is grown, and amusement is thereby provided to a player (e.g., JP-A-2016-185284).

However, in the system described in JP-A-2016-185284, it is often the case that the opportunity to use a lower-ranked game card having a low level or a low degree of rareness which can be acquired relatively easily by lottery processing or clearing a game stage or a task during a game is reduced and, as a result, the game card is scarcely used and is owned for a long period of time uselessly, and the value of the game medium serving as an asset owned by the player is not fully utilized.

SUMMARY

The invention can provide a server system and others capable of improving the utility value of a lower-ranked game medium which is considered to have low value for a game medium owned by a player and tends to be redundant, amusing the player with the combination of game media, and providing an attractive game.

According to a first aspect of the invention, there is provided a server system for causing a terminal device connected via a network to execute a game which progresses using a plurality of game media, the server system including a processor programmed to:

manage the game media which are stored in a storage and owned by each of players and in each of which a rank attribute indicative of a rank is specified, as game medium information for each of the players;

execute, in a case where a game medium of the game media owned by a player who has issued an instruction is used based on the instruction of the player during the game, ability addition-change processing of adding an ability parameter which specifies a given ability or changing a value of the ability parameter in favor of the player, according to the use of the game medium;

execute combination processing of combining a first game medium which serves as a base of the combination processing, and a second game medium which is different from the first game medium and serves as a subordinate of the combination processing;

provide information related to the game which progresses based on the game media including a game medium obtained by the combination to the terminal device;

execute, in a case where a combination instruction to combine the first game medium in which a specific ability parameter is specified with the second game medium is received, determination processing of determining whether or not a given combination condition based on at least the first game medium is met; and execute, in a case where it is determined that the first game medium meets the given combination condition, specific ability addition processing of adding the specific ability parameter specified in the first game medium to the second game medium as the combination processing.

According to a second aspect of the invention, there is provided a method of providing information related to a game which progresses using a plurality of game media to a terminal device connected via a network, the method including: managing the game media which are stored in a storage and owned by each of players and in each of which a rank attribute indicative of a rank is specified, as game medium information for each of the players;

executing, in a case where a game medium of the game media owned by a player who has issued an instruction is used based on the instruction of the player during the game, ability addition-change processing of adding an ability parameter which specifies a given ability or changing a value of the ability parameter in favor of the player according to the use of the game medium;

executing, in combination processing of combining a first game medium which serves as a base of the combination processing, and a second game medium which is different from the first game medium and serves as a subordinate of the combination processing;

providing information related to the game which progresses based on the game media including a game medium obtained by the combination to the terminal device;

executing, in a case where a combination instruction to combine the first game medium in which a specific ability parameter is specified with the second game medium is received, determination processing of determining whether or not a given combination condition based on at least the first game medium is met; and executing, in a case where it is determined that the first game medium meets the given combination condition, specific ability addition processing of adding the specific ability parameter specified in the first game medium to the second game medium as the combination processing.

According to a third aspect of the invention, there is provided a game system for executing a game which progresses using a plurality of game media, the game system including a processor programmed to:

manage the game media which are stored in a storage and owned by each of players and in each of which a rank attribute indicative of a rank is specified, as game medium information for each of the players;

execute, in a case where a game medium of the game media owned by a player who has issued an instruction is used based on the instruction of the player during the game, ability addition-change processing of adding an ability parameter which specifies a given ability or changing a value of the ability parameter in favor of the player according to the use of the game medium;

execute, in combination processing of combining a first game medium which serves as a base of the combination processing, and a second game medium which is different from the first game medium and serves as a subordinate of the combination processing;

execute, in a case where a combination instruction to combine the first game medium in which a specific ability parameter is specified with the second game medium is received, determination processing of determining whether or not a given combination condition based on at least the first game medium is met; and execute, in a case where it is determined that the first game medium meets the given combination condition, specific ability addition processing of adding the specific ability parameter specified in the first game medium to the second game medium as the combination processing.

According to a fourth aspect of the invention, there is provided a terminal device connected to the game system described above via a network, the terminal device including a processor programmed to:

receive an instruction of the player;

transmit the received instruction of the player to the game system and receive game information which includes information related to the combination processing and is related to the game;

cause a display unit to display an image related to the game based on the received game information;

receive an instruction of the player for selecting the first game medium which serves as the base of the combination processing and the second game medium which is different from the first game medium and serves as the subordinate of the combination processing, in order to execute the combination processing of combining the first game medium and the second game medium; and cause the display to display an image related to the combination processing including the specific ability addition processing of adding the specific ability parameter specified in the first game medium to the second game medium based on the game information transmitted from the game system in a case where it is determined that the first game medium selected in the game system meets the given combination condition.

BRIEF DESCRIPTION OF THE SEVERAL VIEWS OF THE DRAWING

FIG. 5 is an example of game card information used in an embodiment of the invention.

Figure 1:
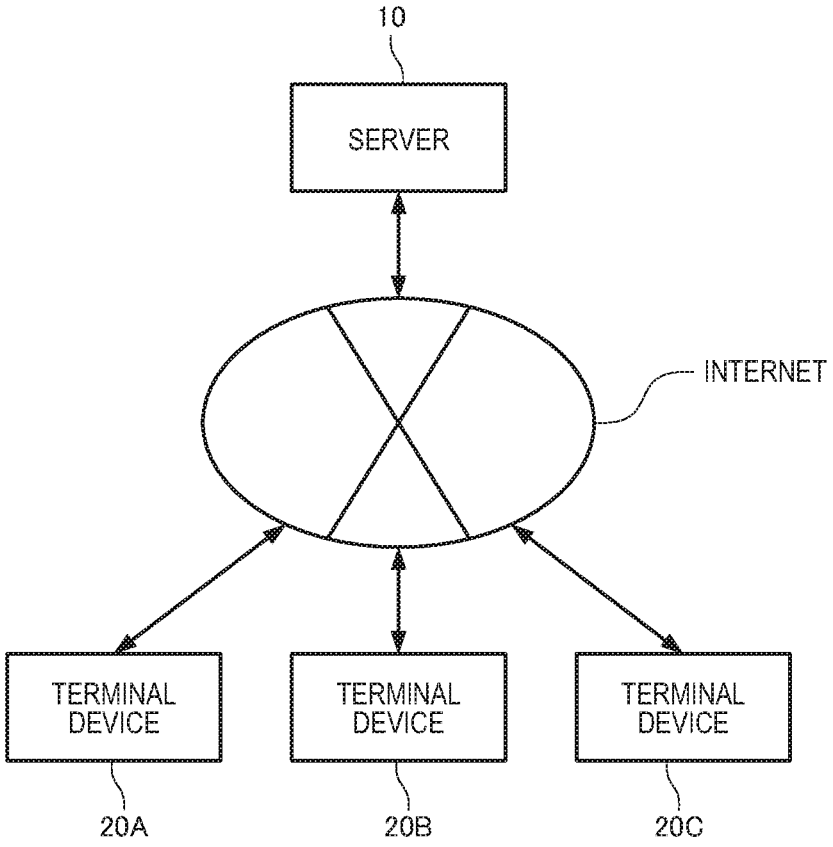
FIG. 1 is a diagram illustrating an example of the configuration of a game system according to an embodiment of the invention.

DETAILED DESCRIPTION OF THE EMBODIMENT (1) According to an embodiment of the invention, there is provided a server system for causing a terminal device connected via a network to execute a game which progresses using a plurality of game media, the server system including a processor programmed to:

manage the game media which are stored in a storage and owned by each of players and in each of which a rank attribute indicative of a rank is specified, as game medium information for each of the players;

execute, in a case where a game medium of the game media owned by a player who has issued an instruction is used based on the instruction of the player during the game, ability addition-change processing of adding an ability parameter which specifies a given ability or changing a value of the ability parameter in favor of the player, according to the use of the game medium;

execute combination processing of combining a first game medium which serves as a base of the combination processing, and a second game medium which is different from the first game medium and serves as a subordinate of the combination processing;

provide information related to the game which progresses based on the game media including a game medium obtained by the combination to the terminal device;

execute, in a case where a combination instruction to combine the first game medium in which a specific ability parameter is specified with the second game medium is received, determination processing of determining whether or not a given combination condition based on at least the first game medium is met; and execute, in a case where it is determined that the first game medium meets the given combination condition, specific ability addition processing of adding the specific ability parameter specified in the first game medium to the second game medium as the combination processing.

In the server system described above, in combination of a plurality of game media (e.g., game cards), for example, when a specific game medium having a higher rank is strengthened, as long as a given combination condition is met, it is possible to use other game media such as lower-ranked game media.

For example, the above-described server system determines that the combination condition is met (A1) in the case where, as the combination condition, a predetermined number of first game media in each of which a specific ability parameter is specified are used in the combination processing at a timing of a combination instruction, (A2) in the case where first game media in each of which a specific parameter is specified and which are acquired successively from the timing of the combination instruction are combined, and a predetermined number of first game media in each of which the specific ability parameter is specified are used in the combination processing within a predetermined time period from the timing of the combination instruction, or (A3) in the case where one first game medium in which a specific ability parameter is specified is used in the combination processing at the timing of the combination instruction and a prize is won in a lottery, and the server system can execute the specific ability addition processing on the second game medium.

In addition, in the server system described above, it is possible to change the first game medium into a medium having a specific ability parameter and change the value of the ability parameter in favor of a player according to the will of the player, and it is possible to add an ability to be strengthened in a specific game medium by combining the specific game medium with another game medium having the ability, and hence it is possible to reflect the will of the player in the strengthening of the game medium.

That is, according to the server system described above, it is possible to reliably reflect the will of a player in alteration of the ability in the second game medium via the first game medium, and improve the utility values of other lower-ranked game media which are considered to have low value for owned game media and tend to be redundant, and hence it is possible to amuse the player with the combination of the game medium and provide an attractive game.

Note that the "game medium" denotes, e.g., a card (i.e., an electronically provided game card) used in a game in which a player character, in-game currency, an item, or an ability (performance) serving as an operation target or an instruction target of a player is specified. Note that the game medium may also be the player character, the in-game currency, the item, the ability (performance), or a character which gets on the player character itself.

In addition, "owning" does not mean physical owning but electronic owning, an owned game medium does not need to be stored in a terminal device owned by a player, and "owning" denotes a state in which the owned game medium can be used by the player freely such as a state in which the owned game medium is stored in a database connected to a network such as the Internet and can be read by the player at any time.

The "ability parameter which specifies a given ability" includes, e.g., an offensive strength, a defensive strength, agility, an experience point, a level, and a hit point in a game medium (e.g., a player character or an item specified in the game medium). Note that the parameter may or may not include a variable value.

Further, "execute ability addition-change processing according to the use of the game medium" denotes that the ability addition-change processing is executed according to, e.g., the number of times of use, a period of use, and a status of use (the number of kills, a winning rate, or the number of times of defeating an opponent character in a match-up game) of the game medium.

In particular, the "ability addition-change processing" denotes, e.g., ability addition processing of adding a parameter which specifies a new ability, and parameter change processing of changing (e.g., increasing or decreasing) the value of the ability parameter which is already specified in favor of a player.

In addition to the foregoing, in the "combination processing", the first game medium may or may not be deleted as the combination processing.

The "combination instruction" includes, e.g., an operation instruction of a player and an instruction from a game program issued in accordance with progress of a game.

The "given combination condition based on at least the first game medium" includes not only the combination condition related to the first game medium but also the combination conditions related to the timing of the combination instruction, a determination time period, and the second game medium.

The "given combination condition" includes, e.g., a condition that a timing at which the combination condition is met is a predetermined timing or a condition that the timing is within a set time period in addition to conditions including the number of first game media (in each of which the specific ability parameter is specified) used in the combination processing, a difference in rank between the first game medium and the second game medium, whether a prize is won in a lottery, or a combination thereof.

Further, the "determination processing of determining whether the first game medium meets the given combination condition" includes, e.g., (B1) determining whether the combination condition is met at the timing of the combination instruction, and (B2) determining whether the combination condition is met within a predetermined time period after the combination instruction.

The "specific ability addition processing" includes, e.g., processing of newly adding the specific ability parameter specified in the first game medium to the second game medium, and processing of changing the value of the specific ability parameter which is already added to the second game medium in favor of a player.

(2) In the server system described above, the processor may execute the combination processing of combining the first game medium which serves as the base and the second game medium which has the rank attribute higher than the rank attribute of the first game medium.

In the server system described above, in combination of a plurality of game media (e.g., game cards), for example, when a specific game medium having a higher rank is strengthened, as long as a given combination condition is met, it is possible to use, e.g., other lower-ranked game media.

Note that the "rank attribute" is an attribute classified according to, e.g., the degree of rareness such as Normal, Rare, S Rare, or SS Rare, the level of the game card itself, or a numerical value indicative of an ability difference, and is an attribute for identifying the game card in association with the rank of another game card by specifying a level of the attribute ranging from low to high.

In particular, the "rank attribute" may be an attribute which does not grow during a game, or may also be an attribute which is altered in the case where a given condition such as an upper limit breakthrough (means that, in a parameter of which an upper limit value is set, the upper limit is reached) is met.

(3) In the server system described above, the given combination condition includes a condition that the player wins a prize in a lottery event, and the processor may change a winning rate of the prize in the lottery event according to the number of the first game medium used in the combination processing.

In the server system described above, it is possible to provide a sense of expectation and a sense of exaltation to a player by using lottery processing in the determination of card combination, and the probability of adding a specific ability parameter to the second game medium is increased by, e.g., using a large number of the first game media in each of which the specific ability parameter is specified in the combination processing. Thus, in the execution of the combination processing, it is possible to request the player to collect and strengthen the first game medium in addition to acquiring the specific ability parameter.

In particular, in the server system described above, by increasing the probability of adding the specific ability parameter to the second game medium as the number of first game media used in the combination increases, it is possible to easily implement difficulty in the evolution and growth of the second game medium by using the first game medium.

Consequently, in the server system described above, it is possible to easily improve the amusement of a game of growing a game card while improving the utility value of a lower-ranked game medium.

(4) In the server system described above, the given combination condition includes a condition that the player serving as a target wins a prize in a lottery event, and in a case where the first game medium to be used in the combination processing is designated during a time period from a timing at which the combination instruction is received to a given timing, the processor may change a winning rate of the prize in the lottery event according to a length of a time period from the timing at which the combination instruction is received to a timing at which the first game medium to be used in the combination processing is designated finally during the time period.

In the server system described above, it is possible to provide a sense of expectation and a sense of exaltation to a player by using lottery processing in the determination of card combination and the probability of adding a specific ability parameter to the second game medium is increased by, e.g., quickly designating the first game medium in which the specific ability parameter is specified as the game medium used in the combination. Thus, in the execution of the combination processing, it is possible to request the player to have strategy for the designation of the first game medium in addition to the acquisition of the specific ability parameter.

Consequently, in the server system described above, it is possible to easily improve the amusement of a game of growing a game card while improving the utility value of a lower-ranked game medium.

In addition, in the server system described above, it is possible to easily improve the amusement of the game while improving the utility value of the lower-ranked game medium, and it is possible to execute the combination processing according to various game progress and adjust the difficulty of the game by adjusting the predetermined time period, and hence it is possible to incorporate the combination processing into various games and various game direction.

Note that the "timing at which the combination instruction is received" may include only a timing at which the combination instruction is received or may also include a timing at which one or more first game media to be used in the combination are designated in addition to the timing at which the combination instruction is received.

In addition, the "given timing" includes a timing in a game such as the end of a stage or the end of a bonus time period, a preset time and date timing, or a timing indicated by a player.

(5) In the server system described above, the given combination condition includes a condition that the player serving as a target wins a prize in a lottery event, and the processor may change a winning rate of the prize in the lottery event according to a difference in rank between the first game medium and the second game medium used in the combination processing.

In the server system described above, it is possible to provide a sense of expectation and a sense of exaltation to a player by using drawing processing in the determination of card combination and, for example, the probability of adding a specific ability parameter to the second game medium increases as the difference in rank therebetween decreases. Thus, in the execution of the combination processing, it is possible to request the player to have strategy for the designation of the first game medium and the second game medium in addition to the acquisition of the specific ability parameter.

Consequently, in the server system described above, it is possible to easily improve the amusement of a game of growing a game card while improving the utility value of a lower-ranked game medium.

(6) In the server system described above, the processor may control cost consumed during execution of the combination processing according to at least one of elements including (a) the number of the first game medium used in the combination processing, (b) in a case where the first game medium to be used in the combination processing is designated during a time period from a timing at which the combination instruction is received to a given timing, a length of a time period from the timing at which the combination instruction is received to a timing at which the first game medium to be used in the combination processing is designated finally during the time period, and (c) a difference in rank between the first game medium and the second game medium used in the combination processing.

In the server system described above, it is possible to facilitate acquisition of a powerful game card and execute speedup of the progress of a game for a player who is willing to use the first game card or be charged, and, on the other hand, it is possible to allow even a player who executes the game without being charged or at minimum cost to properly enjoy the game by (C1) making, by increasing the number of first game media used in the combination processing, cost lower than that in the case where the number of first game media is small, (C2) in the case where, during the time period from the timing at which the combination instruction is received to the given timing, the length of the time period from the timing at which the combination instruction is received to the timing at which the first game medium to be used in the combination processing is designated finally is short, making the cost lower than that in the case where the length of the time period is long, or (C3) in the case where the difference in rank between the first game medium and the second game medium is small, making the cost lower than that in the case where the difference in rank therebetween is large.

Consequently, in the server system described above, it is possible to provide a game which allows various players to enjoy the game widely.

(7) According to an embodiment of the invention, there is provided a method of providing information related to a game which progresses using a plurality of game media to a terminal device connected via a network, the method including: managing the game media which are stored in a storage and owned by each of players and in each of which a rank attribute indicative of a rank is specified, as game medium information for each of the players;

executing, in a case where a game medium of the game media owned by a player who has issued an instruction is used based on the instruction of the player during the game, ability addition-change processing of adding an ability parameter which specifies a given ability or changing a value of the ability parameter in favor of the player according to the use of the game medium;

executing, in combination processing of combining a first game medium which serves as a base of the combination processing, and a second game medium which is different from the first game medium and serves as a subordinate of the combination processing;

providing information related to the game which progresses based on the game media including a game medium obtained by the combination to the terminal device;

executing, in a case where a combination instruction to combine the first game medium in which a specific ability parameter is specified with the second game medium is received, determination processing of determining whether or not a given combination condition based on at least the first game medium is met; and executing, in a case where it is determined that the first game medium meets the given combination condition, specific ability addition processing of adding the specific ability parameter specified in the first game medium to the second game medium as the combination processing.

According to the method of providing information related to a game described above, it is possible to reliably reflect the will of a player in alteration of the ability in the second game medium via the first game medium, and improve the utility values of other lower-ranked game media which are considered to have low value for owned game media and tend to be redundant, and hence it is possible to amuse the player with the combination of the game medium and provide an attractive game.

(8) According to an embodiment of the invention, there is provided a game system for executing a game which progresses using a plurality of game media, the game system including a processor programmed to:

manage the game media which are stored in a storage and owned by each of players and in each of which a rank attribute indicative of a rank is specified, as game medium information for each of the players;

execute, in a case where a game medium of the game media owned by a player who has issued an instruction is used based on the instruction of the player during the game, ability addition-change processing of adding an ability parameter which specifies a given ability or changing a value of the ability parameter in favor of the player according to the use of the game medium;

execute, in combination processing of combining a first game medium which serves as a base of the combination processing, and a second game medium which is different from the first game medium and serves as a subordinate of the combination processing;

execute, in a case where a combination instruction to combine the first game medium in which a specific ability parameter is specified with the second game medium is received, determination processing of determining whether or not a given combination condition based on at least the first game medium is met; and execute, in a case where it is determined that the first game medium meets the given combination condition, specific ability addition processing of adding the specific ability parameter specified in the first game medium to the second game medium as the combination processing.

According to the game system described above, it is possible to reliably reflect the will of a player in alteration of the ability in the second game medium via the first game medium, and improve the utility values of other lower-ranked game media which are considered to have low value for owned game media and tend to be redundant, and hence it is possible to amuse the player with the combination of the game medium and provide an attractive game.

(9) A terminal device according to an embodiment of the invention includes a processor programmed to:

receive an instruction of the player;

transmit the received instruction of the player to the game system and receive game information which includes information related to the combination processing and is related to the game;

cause a display unit to display an image related to the game based on the received game information;

receive an instruction of the player for selecting the first game medium which serves as the base of the combination processing and the second game medium which is different from the first game medium and serves as the subordinate of the combination processing, in order to execute the combination processing of combining the first game medium and the second game medium; and cause the display to display an image related to the combination processing including the specific ability addition processing of adding the specific ability parameter specified in the first game medium to the second game medium based on the game information transmitted from the game system in a case where it is determined that the first game medium selected in the game system meets the given combination condition.

According to the terminal device described above, it is possible to reliably reflect the will of a player in alteration of the ability in the second game medium via the first game medium by using the terminal device, and improve the utility values of other lower-ranked game media which are considered to have low value for owned game media and tend to be redundant, and hence it is possible to amuse the player with the combination of the game medium and provide an attractive game.

Embodiments of the invention are described in detail below. It is noted that the following embodiments do not unduly limit the scope of the invention as stated in the claims. In addition, all of the elements described in the following embodiments are not necessarily essential requirements of the invention.

1. Game System

First, a description will be given of the outline and schematic configuration of a game system 1 according to the embodiment of the invention by using FIG. 1. Note that FIG. 1 is a diagram illustrating an example of the configuration of the game system 1 of the present embodiment.

As illustrated in FIG. 1, the game system 1 is configured such that a sever 10 which provides a game service and a terminal device 20 (e.g., terminal devices 20A, 20B, and 20C) can be connected to the Internet (an example of a network).

A player can acquire a game from the sever 10 via the Internet and play the game by accessing the sever 10 from the terminal device 20. In addition, the player can execute the game while communicating with other players by accessing the sever 10 from the terminal device 20.

In particular, the sever 10 is an information processing device capable of providing a service which allows the player to play the game by using the terminal device 20 which is connected to the sever 10 via the Internet. In addition, the sever 10 can also function as, e.g., an SNS server (i.e., an information processing device which provides a communication-type service) for providing a service which allows communication to be provided between a plurality of players.

Further, in the case where the sever 10 functions as, e.g., the SNS server, the sever 10 can provide a game called a social game which is executed by using an operating environment (an application programming interface (API), a platform, or the like) for the provided SNS.

Specifically, the sever 10 can provide games provided on a Web browser of the terminal device 20, i.e., browser games (games started only by opening an installation site with a Web browser) created by using various languages such as, e.g., HTML, FLASH, CGI, PHP, shockwave, a Java (registered trademark) applet, and JavaScript (registered trademark).

Note that, unlike existing online games, the social game does not need dedicated client software, and includes a game which can be used only with a Web browser and an SNS account. In addition, the sever 10 is configured to be able to provide an online game which allows connection to a terminal (a smartphone, a personal computer, or a game machine) of another player via a network and allows the same game progress to be shared with another player simultaneously on line.

On the other hand, the sever 10 may be constituted by one device or processor or may also be constituted by a plurality of devices or processors.

The sever 10 may store information such as charging information or game information stored in a storage area (a storage 140 described later) of the sever 10 in a database (a storage device or a memory in a broad sense) connected via a network (an intranet or the Internet) and, in the case where the sever 10 functions as the SNS server, the sever 10 may store information in a player information storage section 146 which is stored in the storage area in the database (the storage device or the memory in a broad sense) connected via the network (the intranet or the Internet).

Specifically, the sever 10 receives input information based on an operation of a player of the terminal device 20 (i.e., a player who executes the game), and performs game processing based on the received input information.

Subsequently, the sever 10 transmits a game processing result to the terminal device 20. Note that the terminal device 20 is configured so as to perform various processing of providing the game processing result received from the sever 10 to the terminal device 20 such that the player can view the game processing result.

The terminal device 20 is an information processing device such as an image generation device including a smartphone, a cellular phone, a PHS, a computer, a game machine, a PDA, or a portable game machine, and is a device which can be connected to the sever 10 via a network such as the Internet (WAN) or a LAN. Note that a communications network between the terminal device 20 and the sever 10 may be a wired or wireless communications network.

The terminal device 20 includes a Web browser which allows browsing of a Web page (HTML data). That is, the terminal device 20 includes a communication control function for communicating with the sever 10, and a Web browser function for performing display control by using data (Web data, data created in HTML format, and the like) received from the sever 10 and transmitting data on a player operation to the sever 10.

For example, the terminal device 20 may execute game processing based on a game application stored in a storage area (a storage 270 described later) while acquiring, from the sever 10, necessary information such as game information related to another player at the time of playing against that player, or may execute various processing of providing a game screen to a player to cause the player to execute a game.

In addition, for example, the terminal device 20 may acquire game control information provided from the sever 10 and execute predetermined game processing while transmitting the data on the player operation to the sever 10, and may execute a game based on the game processing.

In particular, in the case where the terminal device 20 executes the game processing based on the game control information provided from the sever 10, when a request for performance of a predetermined game is issued to the sever 10, the terminal device 20 is connected to a game site of the sever 10, and the game is started.

In addition, the terminal device 20 is configured so as to cause, by using the API on an as needed basis, the sever 10 functioning as the SNS server to perform predetermined processing or cause the sever 10 functioning as the SNS server to acquire player information stored in the player information storage section 146 managed by the sever 10 to thereby execute the game.

2. Server Device

Figure 2:
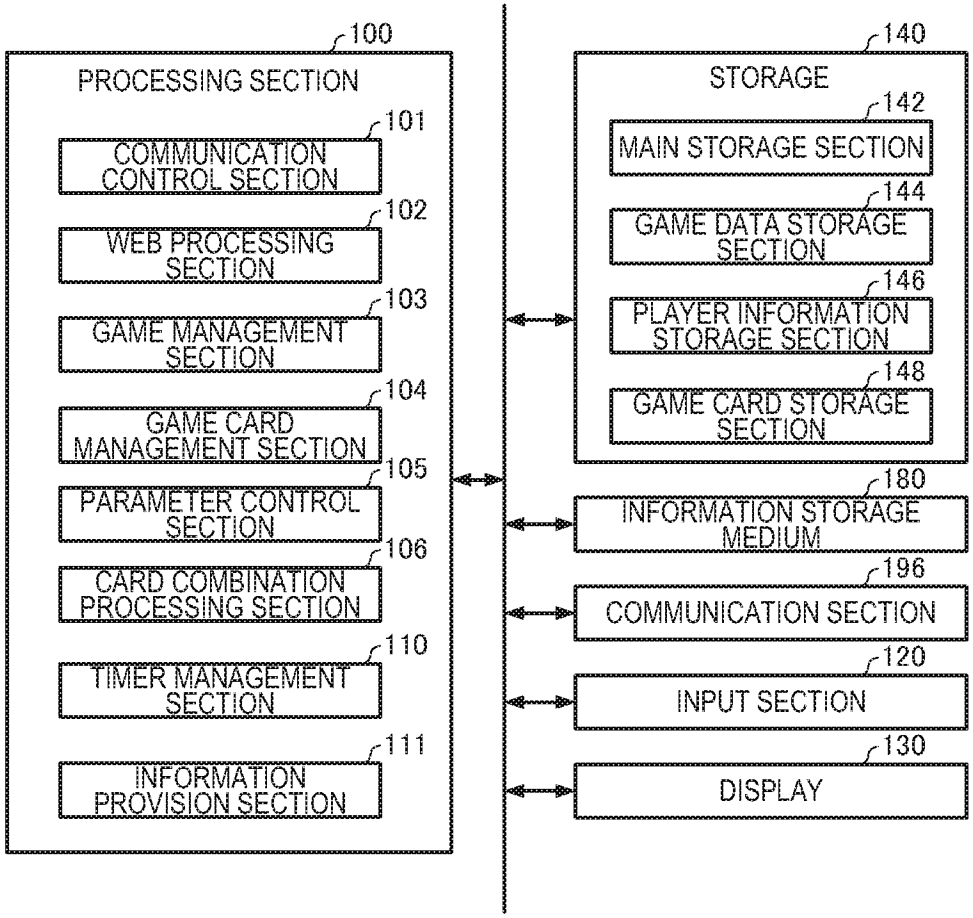
FIG. 2 is a functional block diagram of a sever according to an embodiment of the invention.

Next, the sever 10 will be described by using FIG. 2. Note that FIG. 2 is a functional block diagram of the sever 10. The sever 10 may have a configuration in which part of components (individual sections) in FIG. 2 is omitted.

The sever 10 includes an input section 120 which is used for input by a manager and others, a display 130 which performs predetermined display, an information storage medium 180 in which predetermined information is stored, a communication section 196 which communicates with the terminal device 20 and others, a processing section 100 which executes processing mainly related to a provided game, and a storage 140 which stores various pieces of data mainly used in a game.

The input section 120 is used for settings related to a game and other required settings, and input of data by a system manager or the like. The input section 120 is constituted by, e.g., a mouse and a keyboard.

The display 130 displays an operation screen for the system manager. The display 130 is constituted by, e.g., a liquid crystal display or the like.

The information storage medium 180 (computer-readable medium) stores a program and data, and the function thereof is constituted by an optical disk (CD, DVD), a magneto-optical disk (MO), a magnetic disk, a hard disk, a magnetic tape, or a memory (ROM).

The communication section 196 performs various control for communicating with the outside (e.g., terminals, other servers, and other network systems), and the function thereof is constituted by hardware such as various processors or a communication ASIC, and a program.

The storage 140 serves as a work area of the processing section 100 or the communication section 196, and the function thereof is constituted by a RAM (VRAM) or the like. Note that information stored in the storage 140 may be managed by using a database.

Further, in addition to a main storage section 142, the storage 140 has (A1) a game data storage section 144 which stores various pieces of table data used when game processing is executed, and information related to a game (hereinafter referred to as "game information") including information (including initial values) on a game medium such as a game card provided to a player, (A2) a player information storage section 146 which stores information related to a player (hereinafter referred to as "player information") for each player, and (A3) a game card information storage section 148 which stores a game card owned by each player as game card information in association with each player.

For example, in the game card information storage section 148, information on the game card owned by the player is stored for each player.

In particular, in the game card information storage section 148, various pieces of information including a parameter related to an ability specified in a player character or an item specified in each game card (hereinafter referred to as an "ability parameter"), and initial values and variations thereof are stored as game card information in association with each game card.

Note that the game card is, e.g., (B1) a player character such as a character which serves as an operation target or an instruction target of a player and moves in game space, a character which gets on the player character, or an object set in the game space, (B2) an item which is provided or set, as described above, in the player character operated by the player such as a weapon, a tool, a life energy, or 1 up in a game, (B3) in-game currency, or (B4) an ability or a characteristic set in the character or the object, and is one of electronically provided game media.

When the game card is acquired and owned by a player, the game card is stored in the game card information storage section 148 in association with the corresponding player.

In addition, the game card is provided as, e.g., a virtual game medium in the game, and can be acquired or used (does not need to be acquired by the player) at a predetermined timing in the game.

The processing section 100 performs various processing by using the main storage section 142 in the storage 140 as a work area. The function of the processing section 100 can be implemented by hardware such as various processors (a CPU, a DSP) and an ASIC (a gate array or the like), and a program.

The processing section 100 performs various processing based on a program (data) stored in the information storage medium 180. That is, in the information storage medium 180, a program for causing a computer to function as individual sections (a program for causing a computer to execute processing of individual sections) is stored.

For example, the processing section 100 (processor) performs control of the entire sever 10 based on the program stored in the information storage medium 180, and performs various processing such as control of passing of data or the like between the individual sections. Further, the processing section 100 performs processing of providing various services corresponding to requests from terminals.

Specifically, the processing section 100 has at least a communication control section 101, a Web processing section 102, a game management section 103, a game card management section 104, a parameter control section 105, a card combination processing section 106, a timer management section 110, and an information provision section 111.

The communication control section 101 performs processing of transmitting and receiving data to and from the terminal device 20 via a network. That is, the sever 10 performs various processing based on information received from the terminal device 20 and the like by the communication control section 101.

In particular, the communication control section 101 performs, based on a request from the terminal device 20 of a player, processing of transmitting information related to a game screen and a game to the terminal device 20 of the corresponding player in cooperation with the information provision section 111.

The Web processing section 102 functions as a Web server. For example, the Web processing section 102 performs processing of transmitting data in response to a request of a Web browser 211 installed in the terminal device 20, and processing of receiving data transmitted by the Web browser 211 of the terminal device 20 through a communication protocol such as a hypertext transfer protocol (HTTP).

Note that, in the present embodiment, a description will be made by using the case where the sever 10 includes the function of the SNS server as an example. However, the sever 10 may be formed as a game server and an SNS server which are separate from each other. In addition, part or all of game processing in the present embodiment may be performed by the sever 10, or part thereof may be performed by the terminal device 20.

The game management section 103 executes game processing related to a roll playing game (RPG) or a match-up game in each player based on an operation of a player input via the terminal device 20 in cooperation with the terminal device 20.

In particular, the game management section 103 gives the game card of the character used in the game, and the game card in which the object installed in game space and the item are specified to each player based on an instruction of the player or at a timing set in consideration of game progress (before the start of the game or during the game).

In addition, in cooperation with the terminal device 20, the game management section 103 progresses the game based on the player character, the object, and the item specified in the game card or parameters set therein.

The game card management section 104 registers the game card given to the player in the game card information storage section 148 as game card information together with the parameter specified in the game card, and manages the game card.

In particular, the game card management section 104 stores information (game card information) related to the game card given to the player at a predetermined timing in the game card information storage section 148 for each player, and updates information (game card information) related to the registered game card which changes according to the progress of the game.

In the case where, based on an instruction of a player, a game card owned by the player having issued the instruction is used during the game, the parameter control section 105 executes various processing of adding an ability parameter which specifies a given ability or changing the value of the ability parameter in favor of the player according to the use of the game card.

Specifically, the parameter control section 105 newly adds the ability parameter which specifies the ability of the game card at a predetermined timing (i.e., sets the ability parameter such that the ability parameter can be used in the game), or controls the growth of the ability parameter which is already set (specifically, the change of the value of the ability parameter).

In particular, when the new ability parameter is set, thereafter, the parameter control section 105 changes the value of a special ability parameter (i.e., a growth element) permitted in accordance with the progress of the game to grow (also evolve) the special ability parameter.

The card combination processing section 106 executes processing of combining game cards by using a plurality of game cards (hereinafter referred to as "card combination processing").

In particular, the card combination processing section 106 executes the card combination processing of combining a first game card which serves as a base of the card combination processing and a second game card which is different from the first game card and serves as a subordinate of the card combination processing.

Specifically, as such card combination processing, the card combination processing section 106 executes processing of altering the second game card by using a specific ability parameter specified in the first game card (hereinafter referred to as a "specific ability parameter") by combining the first game card and the second game card.

Note that the second game card preferably has a rank attribute higher than that of the first game card.

The timer management section 107 has a timer function, and is used to manage each time period during a game in cooperation with the game card management section 104 or the terminal device 20.

In particular, the timer management section 107 outputs the current time or preset time to the individual sections based on requests from the game management section 103, the game card management section 104, or other sections. In addition, the timer management section 107 is used to synchronize the individual terminal devices 20.

The information provision section 111 generates various pieces of game information (including information related to direction) for causing a terminal device 20 to perform processing of a game, and provides the game information to the corresponding terminal device 20.

3. Terminal Device

Figure 3:
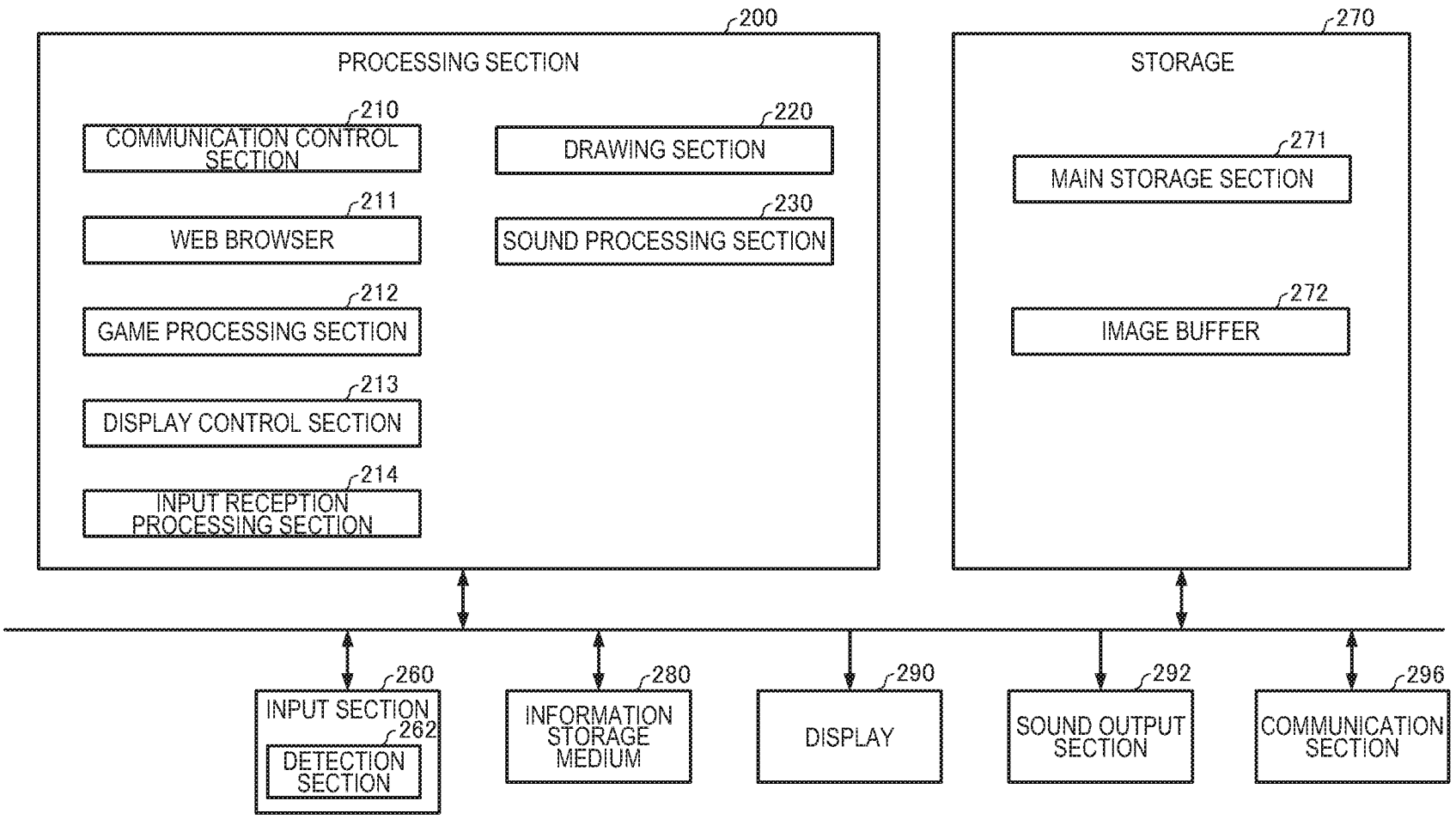
FIG. 3 is a functional block diagram of a terminal device according to an embodiment of the invention.

Next, the terminal device 20 will be described by using FIG. 3. Note that FIG. 3 is a functional block diagram of the terminal device 20. The terminal device 20 may have a configuration in which part of components (individual sections) in FIG. 3 is omitted.

An input section 260 is equipment for inputting input information from a player, and outputs the input information of the player to a processing section 200. The input section 260 includes a detection section 262 which detects the input information (input signal) of the player. The input section 260 is constituted by, e.g., a lever, a button, a steering, a microphone, a touch panel display, a keyboard, or a mouse.

A storage 270 serves as a work area of the processing section 200 or a communication section 296, and the function thereof can be implemented by a RAM (VRAM) or the like. The storage 270 includes a main storage section 271 which is used as a work area, and an image buffer 272 in which a final display image or the like is stored. Note that part of these sections may also be omitted.

An information storage medium 280 (computer-readable medium) stores a program and data. The function thereof can be implemented by an optical disk (CD, DVD), an opto-magnetic disk (MO), a magnetic disk, a hard disk, a magnetic tape, or a memory (ROM).

The processing section 200 performs various processing based on the program (data) stored in the information storage medium 280. The information storage medium 280 can store a program for causing a computer to function as individual sections (a program for causing a computer to execute processing of individual sections).

Note that, in the present embodiment, the program and game data for causing a computer to function as the individual sections of the present embodiment which are stored in the information storage medium 180 and the storage 140 of the sever 10 are received via a network, and the received program and data are stored in the information storage medium 280. The program and data received from the sever 10 may also be stored in the storage 270. Thus, the case where the program and data are received and the network system is caused to function is also included in the scope of the invention.

A display 290 outputs an image generated by each processing. The function thereof can be implemented by a CRT, an LCD, a touch panel display, or a head-mounted display (HMD). A sound output section 292 outputs sound generated by each processing. The function thereof can be implemented by a speaker or a headphone.

A communication section 296 performs various control for communicating with the outside (e.g., other terminals and servers). The function thereof can be implemented by hardware such as various processors or a communication ASIC, or a program.

The processing section 200 (processor) performs processing such as game processing, display control, image generation processing, or sound generation processing based on information related to a game acquired from the sever 10 via the communication section 296, acquired input information from the input section 260, or a program.

The processing section 200 performs various processing by using the main storage section 271 in the storage 270 as a work area. The function of the processing section 200 can be implemented by hardware such as various processors (a CPU, a DSP, and the like) and an ASIC (a gate array or the like), and a program.

The processing section 200 includes a communication control section 210, a Web browser 211, a game processing section 212, a display control section 213, an input reception processing section 214, a drawing section 220, and a sound processing section 230. Note that part of these sections may also be omitted.

The communication control section 210 performs processing of transmitting and receiving data to and from the sever 10. In addition, the communication control section 210 performs processing of storing the data received from the sever 10 in the storage 270, processing of analyzing the received data, and control processing related to transmission and reception of other pieces of data.

Note that the communication control section 210 may perform processing of storing destination information (an IP address and a port number) of a server in the information storage medium 280 and managing the destination information. In addition, in the case where the communication control section 210 receives input information of communication start from a player, the communication control section 210 may communicate with the sever 10.

In particular, the communication control section 210 performs processing of transmitting identification information and operation information of a player to the sever 10, and receiving information related to a game (player information, game card information, a Web page of the player, and a game screen) from the sever 10.

Note that the communication control section 210 may perform data transmission and reception with the sever 10 at predetermined time intervals and, in the case where the communication control section 210 receives the input information from the input section 260, the communication control section 210 may perform data transmission and reception with the sever 10. In particular, the communication control section 210 performs processing of receiving a game screen from the sever 10.

The Web browser 211 is an application program for browsing a Web page (game screen), and the Web browser 211 downloads an HTML file and an image file from a Web server (sever 10), analyzes a layout, and performs display control.

In addition, the Web browser 211 transmits data to the Web server (sever 10) by using an input form (a link, a button, or text box).

The Web browser 211 can implement a browser game. For example, the Web browser 211 may execute programs described in JavaScript (registered trademark), FLASH, and Java (registered trademark) which are received from the Web server (sever 10).

The terminal device 20 can display information from the Web server designated by an URL via the Internet with the Web browser 211.

For example, the terminal device 20 can display the game screen (data in HTML or the like) received from the sever 10 with the Web browser 211.

The game processing section 212 performs various game arithmetic processing. The game arithmetic processing includes, e.g., processing of starting a game in the case where a game start condition is satisfied, processing of progressing the game, and processing of ending the game in the case where a game end condition is satisfied.

In addition, the game processing section 212 may perform processing of disposing and setting various objects (objects constituted by primitives such as a polygon, a free-form surface, and a subdivision surface) representing displayed objects such as a player character, a building, a stadium, a car, a tree, a pillar, a wall, and a map (geographic features) in object space.

Herein, the object space is virtual space, and includes both of two-dimensional space and three-dimensional space. The two-dimensional space is, e.g., space in which an object is disposed in two-dimensional coordinates (X, Y). The three-dimensional space is, e.g., space in which an object is disposed in three-dimensional coordinates (X, Y, Z).

Further, in addition to setting as deck data of a game card, the game processing section 212 executes game processing including transmission and reception control of various pieces of information at the time of login, execution of game processing based on an operation of a player in the case where a game is executed in real time in cooperation with the sever 10, and reproduction of received automatic arithmetic processing data in the case where the game is executed by automatic arithmetic processing.

The display control section 213 performs processing of displaying a game screen generated in the drawing section 220 in the display 290. For example, the display control section 213 may display the game screen by using the Web browser 211.

The input reception processing section 214 performs identification processing of input information input from the input section 260 by a player. Specifically, the input reception processing section 214 receives an instruction of a player for selecting a first game card and a second game card which serve as targets of combination processing.

The drawing section 220 performs drawing processing based on various processing (e.g., game processing) performed in the processing section 200 to thereby generate an image, and outputs the image to the display 290 with the display control section 213. The image generated by the drawing section 220 may be what is called a two-dimensional image or what is called a three-dimensional image.

The sound processing section 230 performs sound processing based on results of various processing performed in the processing section 200 to thereby generate game sound such as a BGM, sound effect, or voice, and outputs the game sound to the sound output section 292.

4. Processing Method 4.1. Outline

Figure 4A:
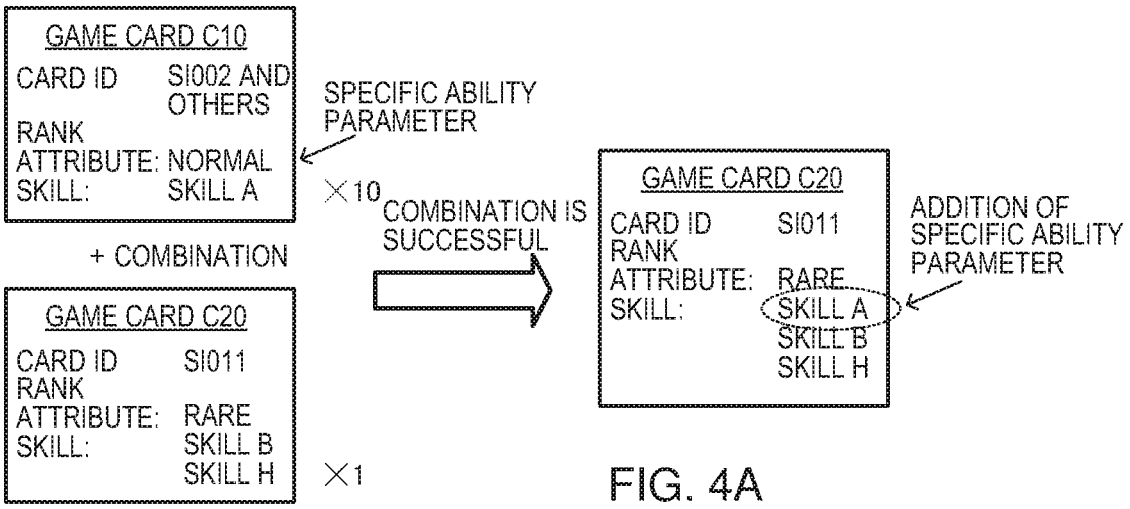
FIGS. 4A to 4C are diagrams for explaining card combination processing according to an embodiment of the invention.
Figure 4B:
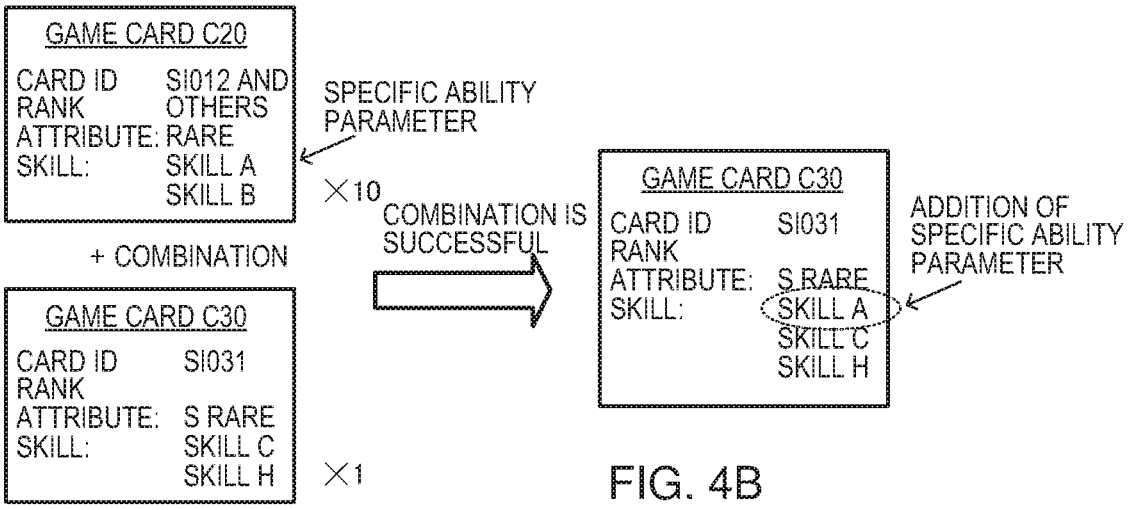
Figure 4C:
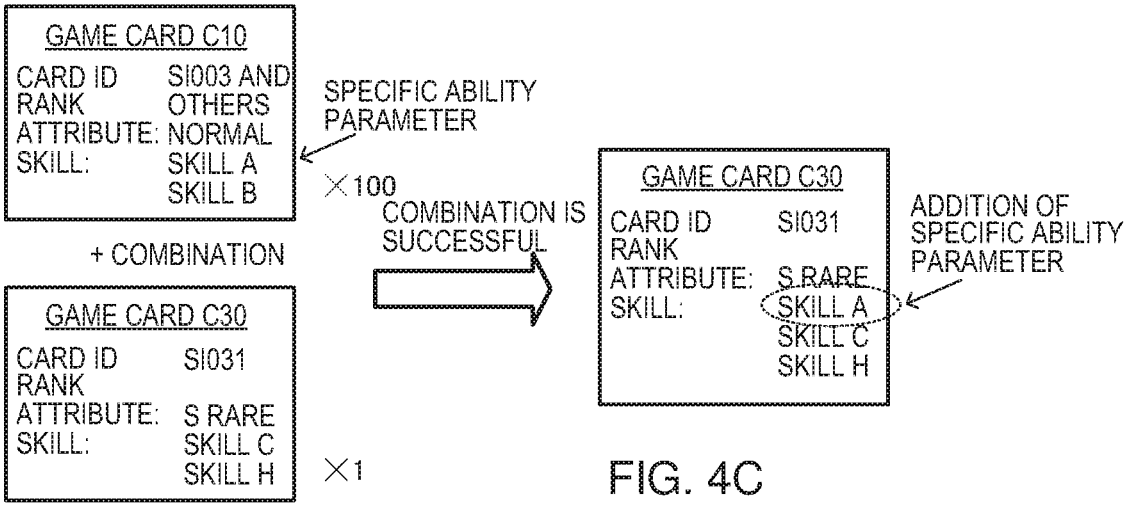

Next, a description will be given of a specific method of card combination processing by using FIGS. 4A to 4C. Note that FIGS. 4A to 4C are diagrams for explaining the card combination processing.

The sever 10 is configured such that each player executes games such as match-up games including a combat game and a battle game, an RPG, or a simulation game by using a plurality of game cards while a player character and other characters, game space or part thereof, a game parameter, a BGM, and a game scenario are provided to each player in cooperation with the terminal device 20.

In addition, the sever 10 is configured so as to execute the card combination processing of generating a game card which is required in order to progress a game or a game card which provides an advantage by combining game cards acquired by each player in accordance with the progress of the game.

In particular, the sever 10 is configured to combine a game card having a lower rank (hereinafter also referred to as a "material game card") which meets a given condition (hereinafter also referred to as a "combination condition") with a game card having a higher rank (hereinafter also referred to as a "combination-source game card") in an attribute which is classified according to, e.g., a level of the game card itself, a degree of rareness, and an ability difference and is specified as being from low to high, thereby strengthening the higher-ranked game card.

Specifically, the sever 10 is configured so as to (A1) manage, for each player, the game card which is owned by each player stored in the storage 140 and in which a rank attribute is specified as the game card information, (A2) execute, in the case where, based on an instruction of a player, the game card owned by the player having issued the instruction is used during the game, ability addition-change processing of adding an ability parameter which specifies a given ability or changing the value of the ability parameter in favor of the player according to the use of the game card, (A3) execute combination processing of combining a first game card and a second game card having a rank attribute higher than that of the first game card, and (A4) provide information related to the game which progresses based on the game cards including a game card obtained by the combination (hereinafter also referred to as a "combined game card") to the terminal device 20.

In addition, in the combination processing in (A3), the sever 10 is configured so as to (A3-1) execute, in the case where a combination instruction to combine the first game card in which a specific ability parameter is specified with the second game card is received, determination processing of determining whether the first game card meets a given combination condition, and (A3-2) execute, in the case where it is determined that the first game card meets the combination condition, specific ability addition processing of adding the specific ability parameter specified in the first game card to the second game card as the combination processing.

For example, we assume the case where a second game card C20 having a rank attribute "Rare" is used as a combination source of the combination processing, the case where the specific ability parameter of Skill A is added to the second game card C20, the case where a first game card C10 having a rank attribute "Normal" which is lower than "Rare" by one rank is used as a material card, and the case where the combination condition requires that 10 first game cards C10 are used.

In these cases, as illustrated in FIG. 4A, when 10 first game cards (card ID: SI002 and others) each having the rank attribute "Normal" and in each of which the specific ability of Skill A is specified are designated as the material cards of the combination processing, the sever 10 succeeds in performing the combination processing to execute the specific ability addition processing as the combination processing of adding Skill A to the second game card C20 (card ID: SI011).

In addition, for example, we assume the case where a second game card C30 having a rank attribute "S Rare" is used as the combination source of the combination processing, the case where the specific ability parameter of Skill A is added to the second game card C30, the case where the first game card C20 having the rank attribute "Rare" which is lower than "S Rare" by one rank is used as the material card, and the case where the combination condition requires that 10 first game cards C20 are used.

In these cases, as illustrated in FIG. 4B, when 10 first game cards (card ID: SI011 and others) each having the rank attribute "Rare" and in each of which the specific ability of Skill A is specified are designated as the material cards of the combination processing, the sever 10 succeeds in performing the combination processing to execute the specific ability addition processing of adding Skill A to the second game card C30 (card ID: SI031).

Further, for example, we assume the case where the second game card C30 having the rank attribute "S Rare" is used as the combination source of the combination processing, the case where the specific ability parameter of Skill A is added to the second game card C30, the case where the first game card C10 having the rank attribute "Normal" which is lower than "S Rare" by two ranks is used as the material card, and the case where the combination condition requires that 100 first game cards C10 are used.

In these cases, as illustrated in FIG. 4C, when 100 first game cards (card ID: SI003 and others) each having the rank attribute "Normal" and in each of which the specific ability of Skill A is specified are designated as the material cards of the combination processing, the sever 10 succeeds in performing the combination processing to execute the specific ability addition processing of adding Skill A to the second game card C30 (card ID: SI031).

With this configuration, the sever 10 can reliably reflect the will of a player in alteration of the ability in the second game card via the first game card.

In addition, the sever 10 can improve the utility value of the lower-ranked game card which is considered to have low value as an owned game card and tends to be redundant.

Consequently, the sever 10 can amuse the player with the combination with another game card and provide an attractive game.

Note that a description will be made by using, e.g., an electronically provided game card as a game medium used in a game. However, as long as the game medium is used in the game, the game medium may be another medium such as a game coin, and the game medium may also be an item or a character itself.

In addition, the game card used in the game is the card owned by the player. "Owning" means, e.g., electronic owning instead of physical owning, and denotes that the game card does not need to be stored in the terminal device owned by the player or the like, and the game card only needs to be in a state in which the game card can be used by the player freely.

That is, "owning" includes a state in which the game card is stored in a database connected to a network such as the Internet and can be read by the player at any time.

Further, hereinbelow, a description will be made by using, as the second game card, a game card having the rank attribute higher than that of the first game card serving as the base card. Note that the second game card may also be a game card functioning as the material card (i.e., a subordinate card) in the combination processing irrespective of the rank attribute.

4.2. Game Card

Next, game cards will be described by using FIG. 5. Note that FIG. 5 is an example of game card information.

4.2.1. Outline of Game Card

The game card is an electronically provided game card which is used in a game in which, e.g., (A1) a player character serving as an operation target and an instruction target of a player, (A2) in-game currency, (A3) an item such as a weapon or a tool with which the player character is provided, (A4) an ability and a characteristic added to the player character, or (A5) a character (hereinafter referred to as a "support character") for progressing the game together with the player character such as a character which gets on the player character is specified.

Each game card is provided to each player in initial settings.

During the execution of the game, each player can acquire the game card (B1) in the case where the player wins a match-up game against another player, (B2) in the case where a predetermined game stage is cleared, the case where the game level of the player is increased, or the case where a predetermined task on a game is completed (including the case where other conditions such as a predetermined time period are present or absent), (B3) in the case where the player wins a prize in a lottery event such as a gacha, (B4) in the case where the game card is presented by another player who is registered as a friend, or (B5) in the case where payment based on in-game currency, points, or items or payment of cost such as charging is executed or the case where the cost is not less than a specific amount.

Note that, when the game card is acquired, the game card management section 104 registers information on the acquired game card as the game card which can be used in the game in the game card information storage section 148 in association with the corresponding player for each player.

In particular, the game card can be used on the game by, e.g., the corresponding terminal device 20 as the game card information, and is registered in the game card information storage section 148 as the game card information such that the game card can be used in the game by the player.

4.2.2. Game Card Information

In each game card, for example, card information illustrated in FIG. 5 is specified.

In the game card information of each game card, (C1) card type information, (C2) attribute information, and (C3) the current value and the upper limit value of an ability parameter are specified in association with a card ID.

The card type information is information indicative of the type of the game card (hereinafter referred to as a "card type") such as, e.g., the player character, the item, or the in-game currency.

The attribute information is information which indicates an attribute classified according to, e.g., the degree of rareness of the game card such as Normal, Rare, S Rare, or SS Rare, the level of the game card itself, or a numerical value indicative of an ability difference, and indicates the rank attribute used for identifying the game card in association with the rank of another game card by specifying a level of the attribute ranging from low to high.

The current value or the upper limit value of the ability parameter denotes the current value or the upper limit value which specifies a given ability such as, e.g., an offensive strength, a defensive strength, agility, an experience point, a level, or a hit point in a player character or an item specified in a game medium.

4.2.3. Ability Parameter

Each game card has at least one ability parameter for specifying the ability and the characteristic of the game card of which the upper limit value is set (i.e., an upper limit setting parameter).

The value of each upper limit setting parameter is changed and controlled in accordance with the progress of the game such as (B1) to (B5) described above.

In addition, in each game card, a level (a card level different from the game level) or the value of the upper limit setting parameter specified in the game card changes (basically a numerical value increases)

(D1) in the case where (B1) and (B2) described above are executed by using the game card, (D2) in the case where the experience point, energy, or item is acquired by using the game card, (D3) in the case where a gacha is performed by using (betting) the game card and a prize is won, or (D4) in the case where payment based on in-game currency, points, or items or payment of cost such as charging is executed.

In addition, the ability parameter of each game card includes the ability parameter which is added when the card combination processing with another game card is executed and is specified in the other game card used in the combination processing.

Note that, in the case where, based on an instruction of a player, a game card owned by the player who has issued the instruction is used in the same manner as in (D1) to (D4) described above during a game, the parameter control section 105 executes the ability addition-change processing of adding the ability parameter or changing (i.e., increasing or decreasing) the value of the ability parameter in favor of the player according to the use of the game card.

In the case where the card level or the value of each ability parameter is changed, the parameter control section 105 updates the game card information registered in the game card information storage section 148 in accordance with the card level or the value of the ability parameter.

4.3. Card Combination Processing

Next, a description will be given of the card combination processing executed by the above-described card combination processing section 106 by using FIG. 6.

Figure 6:
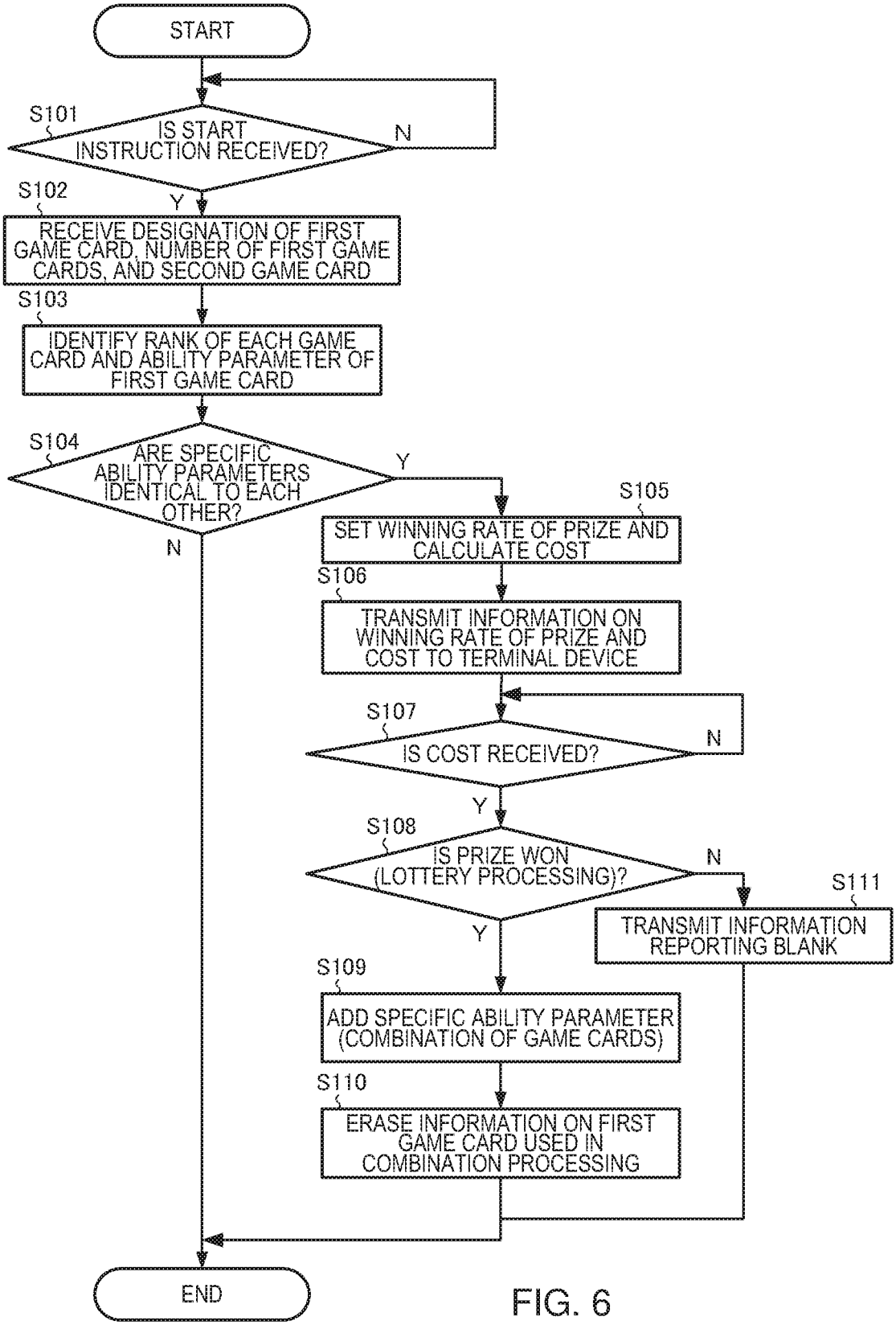
FIG. 6 is a flowchart illustrating the operation of the card combination processing (specific ability addition processing) executed by the sever according to an embodiment of the invention.

Note that FIG. 6 is a diagram for explaining the card combination processing executed by the above-described card combination processing section 106.

4.3.1. Basic Principle of Card Combination Processing

In the card combination processing, the card combination processing section 106 combines, for each player, the first game card (lower-rank game card) which serves as the material card designated by the corresponding player and the second game card which is designated by the player similarly and serves as the combination-source game card having the rank attribute higher than that of the first game card.

In the case where the card combination processing section 106 combines the first game card and the second game card in the above-described manner, the card combination processing section 106 executes determination processing of determining whether a given combination condition including a given combination condition based on at least the first game card is met.

As the determination processing, the card combination processing section 106 determines whether the given combination condition based on at least the first game card is met based on, e.g., an operation instruction of a player transmitted from the terminal device 20 or an instruction from a game program corresponding to the progress of a game.

In addition, as the determination processing, the card combination processing section 106 may determine whether the combination condition is met within a predetermined time period after a combination instruction based on the operation instruction of the player or the instruction from the game program mentioned above.

(A1) In particular, in the case where a predetermined number of first game cards in each of which a specific ability parameter is specified are used in the combination processing (i.e., are designated in the card combination processing) at a timing of the combination instruction such as a timing indicated by the player or a given timing determined on the game, the card combination processing section 106 may determine that the combination condition is met as the determination processing.

(A2) In addition, instead of (A1), in the case where first game cards in each of which a specific ability parameter is specified, which are acquired successively from the timing of the combination instruction, are combined, and a predetermined number of first game cards in each of which the specific ability parameter is specified are used in the combination processing within a predetermined time period from the timing of the combination instruction, the card combination processing section 106 may determine that the combination condition is met as the determination processing.

(A3) Further, instead of (A1) and (A2), in the case where the condition in the determination processing of (A1) or (A2) is met in the first game card used in the combination processing and a prize is won in lottery processing such as a gacha, the card combination processing section 106 may determine that the combination condition is met as the determination processing.

In the case where the card combination processing section 106 executes the determination processing in which it is determined that such a combination condition is met, the card combination processing section 106 executes the specific ability addition processing.

For example, the specific ability addition processing includes a) a higher-ranked game card and a lower-ranked game card in which the ability parameter to be strengthened in the higher-ranked game card is specified are combined, and b) the ability parameter specified in the lower-ranked game card (i.e., the first game card) is added to the higher-ranked game card (i.e., the second game card) and a combined game card is thereby generated.

In particular, as the specific ability addition processing, the card combination processing section 106 executes ability addition processing of adding a new ability to the higher-ranked game card (specifically, newly providing an ability parameter).

Further, in addition to the ability addition processing, the card combination processing section 106 may execute parameter change processing of changing (e.g., increasing or decreasing) the value of the ability parameter which is already specified in favor of a player.

Note that, in the case where the combination processing is executed, the card combination processing section 106 may or may not delete the first game card serving as the material game card.

4.3.2. Basic Principle of Determination Processing

As described above, in the case where the combination instruction to combine the first game card with the second game card is received, the card combination processing section 106 executes the determination processing of determining whether the given combination condition is met.

The given combination condition includes a) the rank of the first game card is lower than the rank of the second game card, b) a predetermined number (e.g., 10) of first game cards are present, and c) the same specific ability parameter is specified in each of a predetermined number of first game cards.

That is, in the execution of the card combination processing, when a large number of first game cards are requested, it is required to not only collect the first game cards but also cause the first game card to evolve and grow the specific ability. As a result, the collection of the first game card by the player results in the growth of the second game card.

Consequently, the sever 10 can easily improve the amusement of the game of growing the game card while improving the utility value of the lowered-ranked game card.

For example, as illustrated in FIG. 4A, we assume the case where the combination condition that, when 10 first game cards are combined at the timing of the combination instruction, the ability parameter of the specific ability parameter specified in each first game card is added to the second game card is set.

In addition, in this case, we assume the case where, as illustrated in FIG. 4A, the card combination processing section 106 receives the combination instruction to combine the first game card in which the specific ability parameter specifying Skill A is specified and which has an attribute of the fourth rank (Normal) which is the fourth rank from the top with the second game card which has an attribute of the third rank (Rare) which is the third rank from the top.

(B1) In this case, the card combination processing section 106 may execute the determination processing of determining, as the combination condition, whether the rank of the first game card serving as the material card is lower than the rank of the second game card serving as the combination-source game card.

(B2) In addition, in this case, instead of (B1), the card combination processing section 106 may execute the determination processing of determining whether Skill A is specified as the specific ability parameter specified in each first game card serving as the material game card.

(B3) Further, in this case, instead of (B1) and (B2), the card combination processing section 106 may execute the determination processing of determining whether 10 first game cards are present at the timing of the combination instruction.

Subsequently, when the card combination processing section 106 determines that all of the combination conditions described above are met, the card combination processing section 106 adds the specific ability parameter of Skill A to the second game card to generate the combined game card.

On the other hand, even in the case where the combination condition is not met at the timing of the combination instruction described above, the card combination processing section 106 may determine that the combination condition is met finally.

For example, the card combination processing section 106 may determine whether a predetermined number (e.g., 10) of first game cards are used in the combination within a given time period (e.g., within 24 hours) from a timing at which the combination instruction is received, instead of the timing of the combination instruction described above. Note that the card combination processing section 106 may determine that the combination condition is met in the case where a predetermined number of first game cards are used in the combination during the game without providing such a time limit.

In addition, as the determination processing, the card combination processing section 106 may change the number of first game cards used in the combination processing according to a difference in rank between the first game card and the second game card.

In this case, in the case where the difference in rank between the second game card and the first game card is, e.g., "1" as described above, the card combination processing section 106 requests "10" first game cards.

On the other hand, in the case where the difference in rank between the second game card and the first game card is, e.g., "2", the card combination processing section 106 may request "50" first game cards or, in the case where the difference in rank between the second game card and the first game card is "3", the card combination processing section 106 may request "100" first game cards.

On the other hand, the card combination processing section 106 may control the ability parameter to be added to the second game card according to the met combination condition.

Specifically, in the combination conditions described above, the card combination processing section 106 may control the ability parameter to be added to the second game card according to at least one of elements including a) the number of first game cards requested in the combination (i.e., the predetermined number described above), b) a time period from a timing at which the combination processing is started (e.g., a timing at which the combination instruction is issued) until the combination condition is met, and c) the difference in rank between the first game card and the second game card.

In particular, in order to provide games meeting desires of various players which include a game having enthusiasm reflected therein for a player having the enthusiasm and a game without a strict combination condition for a beginner, the card combination processing section 106 may control the ability parameter to be added to the second game card in association with a varying combination condition.

(C1) For example, the card combination processing section 106 may increase the level of the specific ability parameter to be added or add a plurality of the specific ability parameters by increasing the number of first game cards used in the combination processing.

(C2) In addition, for example, instead of (C1), the card combination processing section 106 may increase the level of the specific ability parameter or add a plurality of the specific ability parameters in the case where a time period until the combination condition is met is short.

(C3) Further, for example, instead of (C1) and (C2), the card combination processing section 106 may increase the level of the specific ability parameter to be added or add a plurality of the specific ability parameters in the case where a difference in rank between the first game medium and the second game medium is small (or large).

Note that the card combination processing section 106 may set the combination conditions related to, e.g., the number of times of use, a period of use, and a status of use (the number of kills, a winning rate, or the number of times of defeating an opponent character in a match-up game) of the lower-ranked game card.

For example, the card combination processing section 106 sets, as the combination condition, a condition that the number of times of use of the first game card used in the card combination processing is not less than a predetermined number of times of use, a condition that the period of use of the first game card used therein is not less than a predetermined period of use, or a condition that the first game card used therein has a predetermined status of use.

4.3.3. Determination Processing Based on Lottery Processing

In the combination processing of the first game card and the second game card, the card combination processing section 106 may include, as the combination condition, a condition that a player wins a prize in a lottery event in addition to or instead of the combination conditions described above.

In this case, the card combination processing section 106 changes the winning rate of the prize in the lottery event according to the number of first game cards used in the card combination processing.

For example, in such a case, the card combination processing section 106 sets the winning rate of the prize in the lottery event to 10% in the case where 1 first game card is used in the card combination processing, and the card combination processing section 106 sets the winning rate of the prize in the lottery event to 100% in the case where 10 first game cards are used.

On the other hand, in the combination processing of the first game card and the second game card, the card combination processing section 106 may change the winning rate of the prize in the lottery event in the case where, as the combination condition, the first game card used in the combination is designated during a time period from the timing of the combination instruction at which the combination instruction is received to a given timing (hereinafter also referred to as a "combination designation time period") in addition to or instead of the combination conditions described above.

In addition, in this case, for example, in the case where 5 first game cards used in the combination are required, the card combination processing section 106 sets the winning rate of the prize in the lottery event to 100% a) in the case where, as the combination condition, the length of a time period until the 5 first game cards are designated is less than 10 seconds, sets the winning rate of the prize in the lottery event to 50% b) in the case where, as the combination condition, the length of the time period is not less than 10 seconds and less than 10 minutes, and sets the winning rate of the prize in the lottery event to 20% c) in the case where, as the combination condition, the length of the time period is not less than 10 minutes.

On the other hand, in the combination processing of the first game card and the second game card, the card combination processing section 106 may change the winning rate of the prize in the lottery event according to, as the combination condition, a difference in rank between the first game card and the second game card used in the combination in addition to or instead of the combination conditions described above.

In this case, for example, the card combination processing section 106 sets the winning rate of the prize in the lottery event to 100% a) in the case where, as the combination condition, a difference in rank between the first game card and the second game card is "1", sets the winning rate of the prize in the lottery event to 60% b) in the case where, as the combination condition, the difference in rank therebetween is "2", sets the winning rate of the prize in the lottery event to 30% c) in the case where, as the combination condition, the difference in rank therebetween is "3", and sets the winning rate of the prize in the lottery event to 3% d) in the case where, as the combination condition, the difference in rank therebetween is not less than "4".

4.3.4. Determination Processing Based on Cost Control

During the execution of the combination processing, the card combination processing section 106 may request the corresponding player to make a payment by in-game currency, a point, or an item or consume cost such as charging, and change the amount of consumption of the cost according to a game status.

In particular, the card combination processing section 106 may control cost consumed during the execution of the combination processing according to at least one of elements including (D1) the number of first game cards used in the combination processing, (D2) a length of a combination designation time period, and (D3) a difference in rank between the first game card and the second game card which are used in the combination processing.

Note that the length of the combination designation time period denotes the length of a time period from the timing at which the combination instruction is received to a timing at which the first game card used in the combination processing is designated finally in the case where the first game card used in the combination processing is designated during the time period from the timing at which the combination instruction is received to the given timing.

(E1) For example, in the case of (D1), in the case where the number of first game cards used in the combination processing is increased, cost to be consumed is made lower than that in the case where the number of first game cards is small by the card combination processing section 106.

(E2) In addition, for example, in the case of (D2), in the case where the length of the combination designation time period is short, the cost is made lower than that in the case where the length of the combination designation time period is long by the card combination processing section 106.

(E3) Further, for example, in the case of (D3), in the case where a difference in rank between the first game card and the second game card is small, the cost is made lower than that in the case where the difference is large by the card combination processing section 106.

That is, with this configuration, it is possible to facilitate acquisition of a powerful game card and execute speedup of the progress of a game for a player who is willing to use the first game card or be charged.

On the other hand, with this configuration, it is possible to allow a player who executes the game without being charged or at minimum cost to enjoy the game.

For example, in the case where cost consumed during the execution of the combination processing is controlled according to the number of first game cards used in the combination processing, the card combination processing section 106 requests "100" coins as the cost to be consumed in the case where 1 first game card is used, and requests "10" coins as the cost to be consumed in the case where 10 first game cards are used.

In addition, for example, in the case where the cost consumed during the execution of the card combination processing is controlled according to the combination designation time period of the first game card used in the combination processing, the card combination processing section 106 requests "1" coin as the cost to be consumed a) in the case where the combination designation time period until the first game card used in the combination processing is designated finally is less than "10 seconds", requests "10" coins as the cost to be consumed b) in the case where the combination designation time period is not less than "10 seconds" and less than "10 minutes", and requests "50" coins as the cost to be consumed c) in the case where the combination designation time period is not less than "10 minutes".

Further, for example, in the case where the cost consumed during the execution of the combination processing is controlled according to a difference in rank between the first game card and the second game card which are used in the combination processing, the card combination processing section 106 requests "5" coins as the cost to be consumed a) in the case where the difference in rank between the first game card and the second game card is "1", requests "10" coins as the cost to be consumed b) in the case where the difference in rank therebetween is "2", and requests "50" coins as the cost to be consumed c) in the case where the difference in rank therebetween is "3".

Note that the card combination processing section 106 may combine a) the number of first game cards used in the combination processing, b) the combination designation time period of the first game card used in the combination processing, and c) the difference in rank between the first game card and the second game card which are used in the combination processing, and control the cost consumed during the execution of the combination processing corresponding to the combination.

4.4. Processing in Terminal Device

Next, a description will be given of various processing executed by the terminal device 20.

The terminal device 20 is configured so as to (A1) receive an instruction of a player, (A2) transmit the received instruction of the player to the sever 10 and receive game information related to a game which includes information related to combination processing, and (A3) cause the display 290 to display an image related to the game based on the received game information.

Specifically, as described above, in order to cause combination processing in which a first game card and a second game card are combined to be executed, the input reception processing section 214 receives an instruction of the player for selecting the first game card which serves as the base of the combination processing and the second game card which is different from the first game card and serves as the subordinate of the combination processing.

Note that the input reception processing section 214 also receives various instructions related to the game including the combination processing such as a player instruction of payment of cost in the combination processing.

Subsequently, the communication control section 210 transmits the information including the player instruction received by the input reception processing section 214 to the sever 10.

On the other hand, when the display control section 213 receives, via the communication control section 210, the game information which is transmitted from the sever 10 in the case where it is determined that the first game card selected in the sever 10 meets the above-described combination conditions, the display control section 213 causes the display 290 to display the image related to the combination processing including specific ability addition processing of adding a specific ability parameter specified in the first game card to the second game card based on the received game information.

5. Operation of Card Combination Processing

Next, a description will be given of the card combination processing (specific ability addition processing) executed by the sever 10 by using FIG. 6.

Note that FIG. 6 is a flowchart illustrating the operation of the card combination processing (specific ability addition processing) executed by the sever 10.

In the present operation, suppose that card game information (including information on various ability parameters including a specific ability parameter) of each player is pre-stored in the game card information storage section 148.

The present operation is performed for each player, and is an example in the case where the operation is performed for a specific player.

The present operation is an example of the operation in which the combination processing is executed in the case where, as combination conditions, a) the rank of a first game card is lower than that of a second game card at the timing of the combination instruction, b) the same specific ability parameter is specified in each of a plurality of the first game cards, c) a prize is won in lottery processing, and d) predetermined cost is payed.

Further, the present operation is an example in the case where the winning rate of the prize in the lottery processing is changed and the cost to be payed is also changed according to the number of first game cards used in the combination processing.

First, when the card combination processing section 106 receives a start instruction of the combination processing of a player transmitted from the terminal device 20 (Step S101), the card combination processing section 106 receives designation of the first game card and the number of first game cards, and the second game card in cooperation with the terminal device 20 (Step S102).

Next, the card combination processing section 106 identifies the rank of the first game card, the type of the ability parameter specified in the first game card, and the rank of the second game card based on the received first game card and second game card (Step S103).

Subsequently, the card combination processing section 106 determines whether the specific ability parameters specified in one or more designated first game cards are identical to each other (Step S104).

At this point, the card combination processing section 106 causes the operation to proceed to processing in Step S105 in the case where it is determined that the specific ability parameters specified in one or more designated first game cards are identical to each other, and ends the present operation in the case where it is determined that the specific ability parameters specified in one or more designated first game cards are not identical to each other.

Next, in the case where it is determined that the specific ability parameters specified in one or more designated first game cards are identical to each other in the processing in Step S104, the card combination processing section 106 sets the winning rate of the prize in the lottery processing and calculates the cost according to a difference in rank between the first game card and the second game card and the number of first game cards (Step S105).

Subsequently, the card combination processing section 106 transmits individual pieces of information related to the set winning rate of the prize and the cost to the corresponding terminal device 20 in cooperation with the information provision section 111 (Step S106).

Next, when the card combination processing section 106 receives cost identical to the calculated cost based on the instruction of the player transmitted from the terminal device 20 (Step S107), the card combination processing section 106 executes the lottery processing (Step S108).

At this point, in the case where it is determined that a prize is not won in the lottery processing (i.e., in the case of a "blank"), the card combination processing section 106 transmits predetermined game information to the terminal device 20 in order to notify the corresponding layer of the determination result in cooperation with the information provision section 111 (Step S111), and ends the present operation.

Note that, in the case where it is determined that the cost identical to the calculated cost is not received within a predetermined time period in the processing in Step S107, the card combination processing section 106 forcibly ends the present operation (not shown in the drawing).

On the other hand, in the case where it is determined that a prize is won in the lottery processing, the card combination processing section 106 adds the specific ability parameter identified in the processing in Step S103 to the second game card to generate a combined game card (Step S109).

Note that, at this point, the card combination processing section 106 transmits various pieces of game information including information indicative of success of the card combination processing to the terminal device 20 in cooperation with the information provision section 111.

Lastly, the card combination processing section 106 erases information on the game card information of the first game card used in the combination processing while updating the game card information of the second game card serving as the generated combined game card (Step S110), and ends the present operation.

6. Others

The invention is not limited to the embodiment described above, and can be variously modified and implemented. For example, a term cited as a broadly defined or synonymous term in the description in the specification or the drawings can be replaced with a broadly-defined or synonymous term in another description in the specification or the drawings.

In the above description, while the description has been made by using a match-up game in which a battle game is played as the first game and using a simulation game in which a town is built as the second game, the embodiment of the invention is not limited thereto, and the embodiment of the invention may also be applied to various games, e.g., match-up games including sports games such as a baseball game, a football game, and a basketball game, role playing games, and other simulation games.

In addition, in the embodiment of the invention, each game may be provided to the terminal device 20 with one sever 10, or a server system may be constructed by causing a plurality of the sever 10 to cooperate with each other and each game may be provided to the terminal device 20.

The invention includes substantially the same configuration as the configuration described above (e.g., a configuration having the same function, method, and result or a configuration having the same object and effect). In addition, the invention includes a configuration in which portions in the above-described configuration which are not essential are replaced. Further, the invention includes a configuration capable of achieving the same operation and effect as those of the above-described configuration or a configuration capable of achieving the same object as that of the above-described configuration. Furthermore, the invention includes a configuration obtained by adding a known technique to the above-described configuration.

As described above, while the embodiment of the invention has been described in detail, one skilled in the art would readily understand that various modifications may be implemented within a scope that does not substantially depart from the novel features and advantageous effects of the invention. Therefore, such modifications are all included in the scope of the invention.

What is claimed is:

1. A server system for causing a terminal device connected via a network to execute a game which progresses using a plurality of game media, the server system comprising a processor programmed to:

manage the game media which are stored in a storage and owned by each of players and in each of which a rank attribute indicative of a rank is specified, as game medium information for each of the players;

execute, in a case where a game medium of the game media owned by a player who has issued an instruction is used based on the instruction of the player during the game, ability addition-change processing of adding an ability parameter which specifies a given ability or changing a value of the ability parameter in favor of the player, according to the use of the game medium;

execute combination processing of combining a first game medium which serves as a base of the combination processing, and a second game medium which is different from the first game medium and serves as a subordinate of the combination processing;

provide information related to the game which progresses based on the game media including a game medium obtained by the combination to the terminal device;

execute, in a case where a combination instruction to combine the first game medium in which a specific ability parameter is specified with the second game medium is received, determination processing of determining whether or not a given combination condition based on at least the first game medium is met; and execute, upon determination that the first game medium meets the given combination condition, specific ability addition processing of adding the specific ability parameter specified in the first game medium to the second game medium as the combination processing.

2. The server system according to claim 1, wherein the processor is programmed to execute the combination processing of combining the first game medium which serves as the base and the second game medium which has the rank attribute higher than the rank attribute of the first game medium.

3. The server system according to claim 1, wherein the given combination condition includes a condition that the player wins a prize in a lottery event, and the processor is programmed to change a winning rate of the prize in the lottery event according to the number of the first game medium used in the combination processing.

4. The server system according to claim 1, wherein the given combination condition includes a condition that the player serving as a target wins a prize in a lottery event, and in a case where the first game medium to be used in the combination processing is designated during a time period from a timing at which the combination instruction is received to a given timing, the processor is programmed to change a winning rate of the prize in the lottery event according to a length of a time period from the timing at which the combination instruction is received to a timing at which the first game medium to be used in the combination processing is designated finally during the time period.

5. The server system according to claim 1, wherein the given combination condition includes a condition that the player serving as a target wins a prize in a lottery event, and the processor is programmed to change a winning rate of the prize in the lottery event according to a difference in rank between the first game medium and the second game medium used in the combination processing.

6. The server system according to claim 1, wherein the processor is programmed to control cost consumed during execution of the combination processing according to at least one of elements including (a) the number of the first game medium used in the combination processing, (b) in a case where the first game medium to be used in the combination processing is designated during a time period from a timing at which the combination instruction is received to a given timing, a length of a time period from the timing at which the combination instruction is received to a timing at which the first game medium to be used in the combination processing is designated finally during the time period, and (c) a difference in rank between the first game medium and the second game medium used in the combination processing.

7. A method of providing information related to a game which progresses using a plurality of game media to a terminal device connected via a network, the method comprising:

managing the game media which are stored in a storage and owned by each of players and in each of which a rank attribute indicative of a rank is specified, as game medium information for each of the players;

executing, in a case where a game medium of the game media owned by a player who has issued an instruction is used based on the instruction of the player during the game, ability addition-change processing of adding an ability parameter which specifies a given ability or changing a value of the ability parameter in favor of the player according to the use of the game medium;

executing, in combination processing of combining a first game medium which serves as a base of the combination processing, and a second game medium which is different from the first game medium and serves as a subordinate of the combination processing;

providing information related to the game which progresses based on the game media including a game medium obtained by the combination to the terminal device;

executing, in a case where a combination instruction to combine the first game medium in which a specific ability parameter is specified with the second game medium is received, determination processing of determining whether or not a given combination condition based on at least the first game medium is met; and executing, upon determination that the first game medium meets the given combination condition, specific ability addition processing of adding the specific ability parameter specified in the first game medium to the second game medium as the combination processing.

8. A game system for executing a game which progresses using a plurality of game media, the game system comprising a processor programmed to:

manage the game media which are stored in a storage and owned by each of players and in each of which a rank attribute indicative of a rank is specified, as game medium information for each of the players;

execute, in a case where a game medium of the game media owned by a player who has issued an instruction is used based on the instruction of the player during the game, ability addition-change processing of adding an ability parameter which specifies a given ability or changing a value of the ability parameter in favor of the player according to the use of the game medium;

execute, in combination processing of combining a first game medium which serves as a base of the combination processing, and a second game medium which is different from the first game medium and serves as a subordinate of the combination processing;

execute, in a case where a combination instruction to combine the first game medium in which a specific ability parameter is specified with the second game medium is received, determination processing of determining whether or not a given combination condition based on at least the first game medium is met; and execute, upon determination that the first game medium meets the given combination condition, specific ability addition processing of adding the specific ability parameter specified in the first game medium to the second game medium as the combination processing.

9. A terminal device connected to the game system according to claim 8 via a network, the terminal device comprising a processor programmed to:

receive an instruction of the player;

transmit the received instruction of the player to the game system and receive game information which includes information related to the combination processing and is related to the game;

cause a display unit to display an image related to the game based on the received game information;

receive an instruction of the player for selecting the first game medium which serves as the base of the combination processing and the second game medium which is different from the first game medium and serves as the subordinate of the combination processing, in order to execute the combination processing of combining the first game medium and the second game medium; and cause the display to display an image related to the combination processing including the specific ability addition processing of adding the specific ability parameter specified in the first game medium to the second game medium based on the game information transmitted from the game system upon determination that the first game medium selected in the game system meets the given combination condition.

* * * * *